US007954675B2

(12) United States Patent
Gardet et al.

(10) Patent No.: US 7,954,675 B2
(45) Date of Patent: Jun. 7, 2011

(54) BOTTLE COMPRISING A NECK CONNECTED TO A BODY

(75) Inventors: Pierre Gardet, Cuisery (FR); Andrew Jonathan Slinn, Cuisery (FR)

(73) Assignee: Rexam Dispensing SMT S.A. (FR)

( * ) Notice: Subject to any disclaimer, the term of this patent is extended or adjusted under 35 U.S.C. 154(b) by 517 days.

(21) Appl. No.: 12/022,674

(22) Filed: Jan. 30, 2008

(65) Prior Publication Data

US 2008/0179272 A1 Jul. 31, 2008

(30) Foreign Application Priority Data

Jan. 30, 2007 (FR) ..... 07 00639

(51) Int. Cl.
*B65D 88/54* (2006.01)

(52) U.S. Cl. ..... 222/321.7; 222/321.9

(58) Field of Classification Search ..... 222/321.9, 222/385, 321.7; 215/40
See application file for complete search history.

(56) References Cited

U.S. PATENT DOCUMENTS 3,957,178 A * 5/1976 Steiman ..... 222/321.9
3,998,363 A * 12/1976 Beres et al. ..... 222/321.9
6,240,979 B1 * 6/2001 Lorscheidt ..... 141/2
6,371,333 B2 * 4/2002 Lorscheidt et al. ..... 222/321.9
6,966,465 B2 * 11/2005 Kang, III ..... 222/321.9
2001/0025863 A1 * 10/2001 Lorscheidt et al. ..... 222/256
2007/0138209 A1 * 6/2007 Knauer et al. ..... 222/207

FOREIGN PATENT DOCUMENTS

EP 0 584 391 3/1994
EP 0 906 873 4/1999
EP 1 464 408 10/2004

OTHER PUBLICATIONS

French Search Report, Sep. 19, 2007, 2 pages.
French Opinion, Sep. 19, 2007, 4 pages.

* cited by examiner

*Primary Examiner* — Frederick C. Nicolas
(74) *Attorney, Agent, or Firm* — St. Onge Steward Johnston & Reens, LLC

(57) ABSTRACT

A bottle made of a plastic material, including a body surmounted by a neck including a dispensing opening. The neck and the body are made in two separate parts which are assembled together in order to connect the interior of the body to the dispensing opening, the neck includes an axial sealing skirt which is mounted on an axial bearing surface formed on the upper portion of the body. The bottle further includes a shrunk-on collar, the lower portion of which is arranged to axially cover at least the connection area between the neck and the body. The connection of the neck to the body is produced by combining a tight fitting of the exterior surface of the sealing skirt over the interior surface of the bearing surface, and radial clamping of the lower portion of the shrunk-on ring onto the exterior surface of the bearing surface.

11 Claims, 1 Drawing Sheet

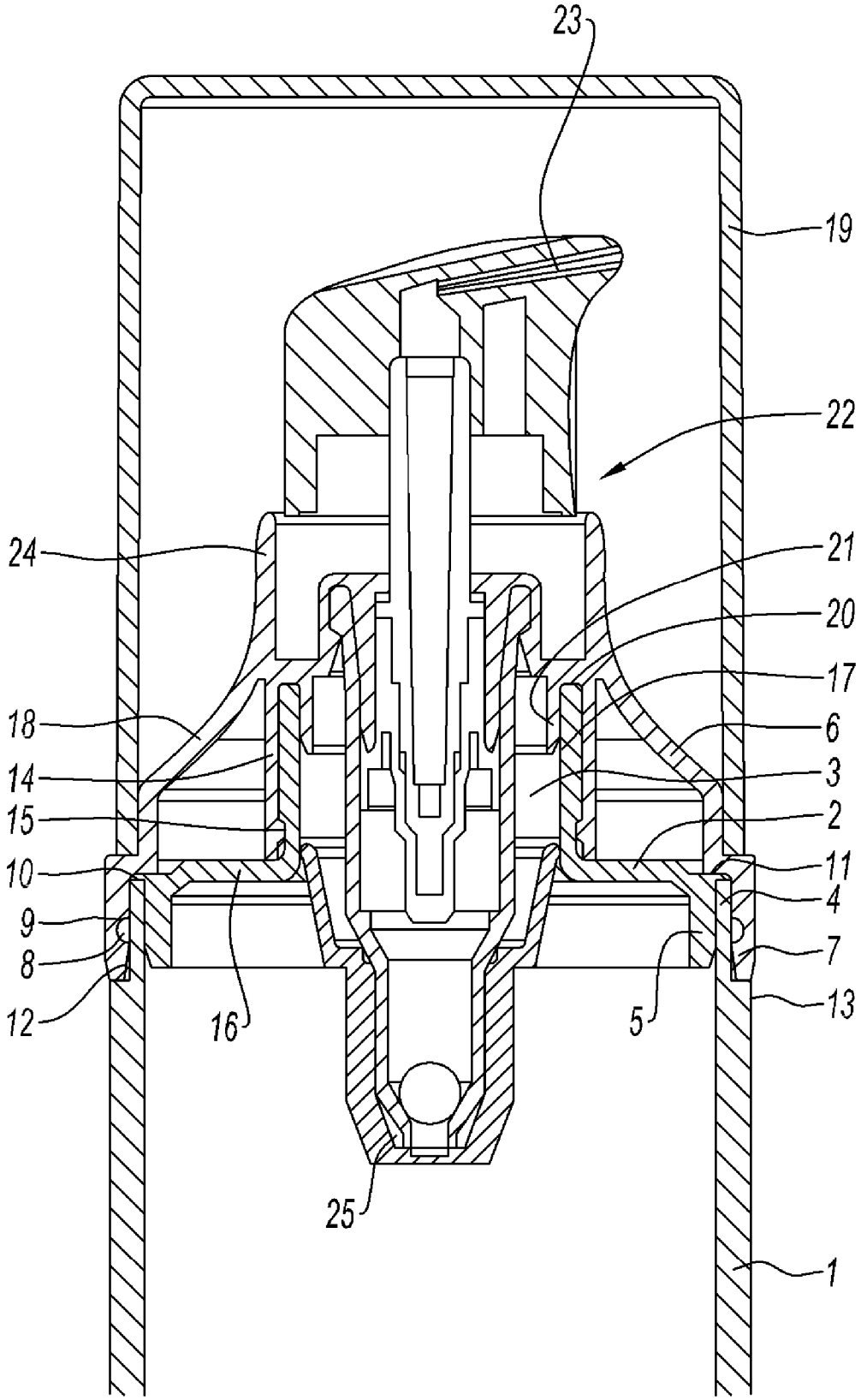
23
19
22
24
21
20
17
18
6
14
3
15
2
10
11
4
9
7
8
12
16
5
13
25
1

BOTTLE COMPRISING A NECK CONNECTED TO A BODY

CROSS-REFERENCE TO RELATED APPLICATIONS

The present application claims priority of French patent application No. 07 00639 filed on Jan. 30, 2007, the content of which is incorporated herein by reference.

FIELD OF THE INVENTION

The invention relates to a bottle made of a plastic material consisting of a body surmounted by a neck comprising a dispensing opening through which a fluid contained in said body can be dispensed, e.g., by means of a pump.

BACKGROUND OF THE INVENTION

In particular applications, the fluid may be a liquid or a cream, e.g., a perfume, a cosmetic product or a pharmaceutical product.

In particular, when the bottle is produced by injection moulding, it is known to make it in two separate pieces, forming the neck and the body, respectively, which are assembled together in order to connect the interior of the body to the dispensing opening.

According to the prior art, the connection can be made by snapping the neck onto the end of the body. However, in this embodiment, problems occur with respect to the seal and mechanical strength in the area of the snap-connection.

In order to attempt to meet these requirements, it has been proposed to attach the neck onto the body via welding or glueing. However, these embodiments complicate the manufacture of the bottle, and therefore increase the cost thereof.

Furthermore, according to known embodiments, the connection area does not have an appearance in conformity with the requirements of anticipated uses, in particular as concerns the absence of drips, material spill-overs or local deformations. In particular, in the case of a snap-connection, improving the mechanical strength and seal of the connection area results in more significant deformations of said area.

In order to solve this problem of appearance, the prior art proposes to conceal the connection area by means of a shrunk-on ring, the lower portion of which is arranged to cover said connection area axially.

SUMMARY OF THE INVENTION

The invention aims to improve on the prior art by proposing a bottle in which the added-on neck is connected to the body while, on the one hand, optimally ensuring the seal and, on the other hand, via clamping of the connection area, and does so while making it possible to give the bottle an advantageous appearance.

To that end, the invention proposes a bottle made of plastic material, consisting of a body surmounted by a neck comprising a dispensing opening, said neck and said body being made in two separate parts which are assembled together in order to connect the interior of the body to the dispensing opening, wherein said neck includes an axial sealing skirt which is mounted on an axial bearing surface formed on the upper portion of the body, said bottle further comprising a shrunk-on collar, the lower portion of which is arranged to axially cover at least the connection area between the neck and the body, wherein the connection of the neck to the body is produced by combining a tight fitting of the exterior surface of the sealing skirt over the interior surface of the bearing surface; and radial clamping of the lower portion of the shrunk-on ring onto the exterior surface of the bearing surface.

BRIEF DESCRIPTION OF THE DRAWINGS

Other objects and advantages of the invention will become apparent in the following description, made with reference to the appended FIGURE showing a partial longitudinal section of a bottle according to one embodiment.

DETAILED DESCRIPTION OF THE INVENTION

In the description, the spatial positioning terms are taken with reference to the position of the bottle shown in the FIGURE.

An embodiment of a bottle intended to contain a fluid for the dispensing thereof, is described in relation to the FIGURE. In particular examples, the fluid may be a liquid or a cream, e.g., a perfume, a cosmetic product or a pharmaceutical product.

The bottle is made of a plastic material, in particular polypropylene, in order to comprise a body 1 surmounted by a neck 2 provided with a dispensing opening 3. In particular, the bottle can be produced by ordinary injection moulding of said material so as to produce two separate parts, forming the neck 2 and the body 1, respectively, which are assembled together in order to connect the interior of the body 1 with the dispensing opening 3. As a matter of fact, in the case where the neck 2 has a smaller cross-sectional area than that of the body 1, producing the bottle in a single piece via ordinary injection moulding proves to be impossible.

In the embodiment described, the body 1 consists of a hollow tube of constant cross section, the lower portion of which is closed by a radial wall (not shown) and the upper portion of which includes a connecting bearing surface 4 of the neck 2. In order to enable the connection, the neck 2 includes an axial sealing skirt 5 at the lower portion thereof, which is mounted on said bearing surface.

More particularly, the exterior surface of the sealing skirt 5 is fitted tightly onto the interior surface of the bearing surface 4, said fit being produced substantially without any radial clamping. In this way, the fit does not cause any radial deformation of the connection area, in particular as concerns the exterior surface of the bearing surface 4.

In the embodiment described, the tight, radial clamping-free fit is produced by providing for the exterior surface of the sealing skirt 5 and the interior surface of the bearing surface 4 to have a cylindrical geometry. More precisely, these two surfaces have an identical geometry with a cross section of substantially identical value. In this way, the seal is produced along the entire length of the interface area, without any localized radial deformation of said interface.

In two exemplary embodiments, the cylindrical geometry of the exterior surface of the sealing skirt 5 and the interior surface of the bearing surface 4 is rotational or an oval directional curve.

However, the smooth fit thus obtained does not have sufficient mechanical strength, in particular for withstanding impacts and other mechanical stresses that the bottle must undergo during the use thereof.

The bottle further includes a shrunk-on collar 6, made, in particular, of a plastic material, e.g., a material identical to that of the body 1 and the neck 2. The shrunk-on collar 6 includes a lower portion 7 which is arranged to axially cover at least the connection area between the body 1 and the neck 2.

In addition to its aesthetic function, the shrunk-on collar 6, in combination with the smooth fit, facilitates attachment of the neck 2 onto the body 1. To accomplish this, the lower portion 7 of the shrunk-on collar 6 is arranged to ensure radial clamping over the exterior surface of the bearing surface 4, which indirectly ensures the mechanical strength of the smooth fit, since the latter is disposed radially opposite the clamping area.

The means for carrying out the sealing and mechanical strength functions are therefore separate, thereby making it possible to optimize the combined results obtained with respect to these two functions. Furthermore, the radial clamping over the bearing surface 4 is performed inwardly, which, besides preserving the outward appearance of the bottle, stresses the material under compression so as to induce a clamping force that is greater than that produced by the expansion of said material. Finally, radial clamping of the exterior surface of the bearing surface 4 likewise tends to increase the reliability of the seal opposite this surface, i.e., between the neck 2 and the body 1.

According to one embodiment, the radial clamping is produced by providing for the exterior surface of the bearing surface 4 and/or the interior surface of the lower portion 7 of the shrunk-on collar 6 to include at least one annular bead 8. In this way, clamping is produced via material deformation, when the bead is inserted into the surface disposed opposite thereto. In addition, clamping may be produced via a snap connection, by providing for at least one annular bead 8 to be inserted into at least one annular groove 9 provided on the surface disposed opposite thereto.

In the embodiment shown, the exterior surface of the bearing surface 4 includes an outwardly protruding annular bead 8, and an annular groove 9 for receiving the bead is formed on the interior surface of the lower portion 7 of the shrunk-on collar 6.

Furthermore, in order to improve the seal between the neck 2 and the body 1, the upper end of the exterior surface of the sealing skirt 5 is delimited by an external radial shoulder 10, said shoulder bearing tightly against the upper end of the bearing surface 4. Furthermore, in the embodiment shown, the lower portion 7 of the shrunk-on collar 6 is surmounted by an internal radial shoulder 11, said shoulder bearing tightly against the external radial shoulder 10 of the sealing skirt 5.

As shown in the FIGURE, it is likewise anticipated for the exterior surface of the bearing surface 4 to be formed inside an annular seat 12 for receiving the lower portion 7 of the shrunk-on collar 6. The seat 12 is arranged so that the exterior surface of the lower portion 7 is positioned within the axial extension of the exterior surface of the body 1. In order to accomplish this, the seat 12 has a cross-sectional area smaller than that of the body 1 with a difference substantially equal to the thickness of the lower portion 7, and the axial dimension of said seat is substantially equal to that of said lower portion 7, so that the lower end of said shrunk-on collar 6 comes into contact with the lower edge 13 of said seat.

In the embodiment described, in order to improve the seal in the area of the dispensing opening 3, the shrunk-on collar 6 further includes an axial bearing surface 14 which is tightly mounted, in particular by fitting onto the periphery of the dispensing opening 3. Furthermore, in the vicinity of its lower end, the interior surface of the axial bearing surface 14 includes an annular bead 15 enabling the shrunk-on collar 6 to be snapped on around the dispensing opening 3.

More precisely, the added-on neck 2 has an annular geometry with an internal radial bearing surface 16 which surmounts the sealing skirt 5, and an upper axial wall 17 inside of which the dispensing opening 3 is formed.

The shrunk-on collar (6) also has an annular geometry, the lower clamping portion 7 having a cross-sectional area larger than that of the axial bearing surface 14, said portion and said bearing surface being interconnected via an axi-radial wall 18, which extends beyond the dispensing opening 3. Additionally, the bottle includes a characteristic cap 19, which is mounted onto the shrunk-on collar 6 in the vicinity of the connection area between the lower clamping portion 7 and an axial portion of the axi-radial wall 18.

In addition, and again in order to improve the seal between the shrunk-on collar 6 and the dispensing opening 3, the axial bearing surface 14 is surmounted by an internal radial shoulder 20, which bears against the end of said opening. The shrunk-on collar 6 includes another axial bearing surface 21, which is in tight contact with the interior of the upper axial wall 17.

In this way, the bottle can integrate a dispensing pump 22, said pump being mounted over the opening 3 so as to enable dispensing of the fluid contained inside the body 1. In order to accomplish this, the pump 22 is mounted over the opening 3 by means of the shrunk-on collar 6, in particular by providing for the body of the pump to be disposed inside the dispensing opening 3. In particular, the pump 22 includes a push-button 23, which is mounted in translation inside an upper axial portion 24 of the axi-radial wall 18.

In the embodiment shown, the pump 22 includes a purge ring 25 disposed inside the body 1, said ring being suitable for a non-air-recycling type of dispensing bottle. Alternatively, a plunger tube can be mounted at the lower portion of the pump 22 in order to be submerged in the fluid, so as to supply the pump 22 with the fluid to be dispensed.

What is claimed is:

1. A bottle made of a plastic material, consisting of a body surmounted by a neck comprising a dispensing opening, said neck and said body being made in two separate parts which are assembled together in order to connect the interior of the body to the dispensing opening, wherein said neck includes an axial sealing skirt which is mounted on an axial bearing surface formed on an upper portion of the body, said bottle further comprising a shrunk-on collar, a lower portion of which is arranged to axially cover at least a connection area between the neck and the body, wherein a connection of the neck to the body is produced by combining:

a tight fitting of the exterior surface of the sealing skirt over the interior surface of the bearing surface; and radial clamping of the lower portion of the shrunk-on ring onto the exterior surface of the bearing surface;

wherein the shrunk-on collar further includes an axial bearing surface which is mounted tightly over a periphery of the dispensing opening.

2. The bottle according to claim 1, wherein the exterior surface of the sealing skirt and the interior surface of the bearing surface have a cylindrical geometry.

3. The bottle according to claim 1, wherein the upper end of the exterior surface of the sealing skirt is delimited by an external radial shoulder, said shoulder bearing tightly against the upper end of the bearing surface.

4. The bottle according to claim 3, wherein the lower portion of the shrunk-on ring is surmounted by an internal radial shoulder, said shoulder bearing tightly against the external radial shoulder of the sealing skirt.

5. The bottle according to claim 1, wherein the exterior surface of the bearing surface and/or the interior surface of the lower portion of the shrunk-on collar includes at least one annular bead.

6. The bottle according to claim 5, wherein at least one annular bead is inserted into at least one annular groove provided on the surface disposed opposite thereto.

7. The bottle according to claim 1, wherein the exterior surface of the bearing surface is formed inside an annular seat for receiving the lower portion of the shrunk-on collar, said seat being arranged such that the exterior surface of the lower portion of the shrunk-on collar is positioned within the axial extension of the exterior surface of the body.

8. The bottle according to claim 1, wherein the axial bearing surface is surmounted by an internal radial shoulder which bears against the end of the dispensing opening.

9. The bottle according to claim 8, wherein the shrunk-on collar further includes an axial bearing surface which is in tight contact with the interior of an upper axial wall inside of which the dispensing opening is formed.

10. The bottle according to claim 1, wherein a dispensing pump is mounted over the opening so as to enable dispensing of a fluid contained inside the body, said pump being mounted over the opening by means of the shrunk-on collar.

11. The bottle according to claim 2, wherein the upper end of the exterior surface of the sealing skirt is delimited by an external radial shoulder, said shoulder bearing tightly against the upper end of the bearing surface.

* * * * *